US006925697B2

(12) United States Patent
Kratz

(10) Patent No.: US 6,925,697 B2
(45) Date of Patent: Aug. 9, 2005

(54) GUARD RAIL TOOL

(76) Inventor: Clarence A. Kratz, 748 River Rd., Calicoon, NY (US) 12723

( * ) Notice: Subject to any disclaimer, the term of this patent is extended or adjusted under 35 U.S.C. 154(b) by 399 days.

(21) Appl. No.: 10/117,606

(22) Filed: Apr. 5, 2002

(65) Prior Publication Data

US 2003/0188411 A1 Oct. 9, 2003

(51) Int. Cl.[7] ..... B25B 1/14
(52) U.S. Cl. ..... 29/267
(58) Field of Search ..... 29/267, 268, 245, 29/261, 281.5, 281.1; 269/228

(56) References Cited

U.S. PATENT DOCUMENTS 1,638,703 A * 8/1927 Pendleton ..... 81/3.8
4,074,898 A * 2/1978 Samuelson ..... 269/228

* cited by examiner

*Primary Examiner*—Robert C. Watson

(57) ABSTRACT

A Guard Rail Tool for installing guard rails along a road or a highway. A fixed claw and a rotatable claw are mounted on opposite sides of a fixed handle which presses against the guard rails when a rotatable handle is closed against the fixed handle.

14 Claims, 4 Drawing Sheets

GUARD RAIL TOOL

BACKGROUND OF THE INVENTION

1. Field of the Invention

This invention relates to tools and more particularly to a tool for installing guard rails along a road or highway.

2. Prior Art and Objects

Along roads and highways, guard rails of steel are virtually universally used. On some occasions, guard rails are referred to as "guide rails." The guard rail, to which this invention applies, is more specifically known as ribbon or W guard rail, which guard rail has a wavy cross section, with a protrusion, when facing the outside surface, along each edge and with an indentation between the two protrusions. Guard rail usually comes in lengths of thirteen feet and at each end there are nine holes, eight of which are used to secure, by means of bolts, the guard rail sections to one another and the ninth hole, located in the center, is used to secure the guard rail, also by a bolt, to a post mounted in the ground. The two connecting guard rails overlap one another approximately a foot at the point of connection to one another and to the post.

Various make-shift devices have been used in the past such as chain binders and come-alongs to force the overlapping sections of guard rail together and to align the holes to insert the bolts but these devices offered only limited assistance. The interlocking rail sections are made with the same dimensions, making the insertion of one section into another difficult, thus requiring great pressure to force the two together. The devices previously used frequently deformed, at least moderately, the guard rails and the connecting rails were held at best loosely leaving bolting still to be a difficult operation.

There has thus always been a need for a tool designed for use in connecting adjoining lengths of guard rail to one another that would force the connecting ends of the guard rails closely against one another and readily permit the alignment of the bolt holes and connection to the post.

Accordingly, it is an object of the present invention to provide a tool for installing guard rails along highways and roads that readily presses the ends of two connecting rail sections together.

It is a further object of the present invention to provide a tool for installing guard rails that reduces substantially the amount of required man hours for installation.

It is still another object of the present invention to force the guard rails against the vertical post upon which the guard rail is mounted.

It is still another object of the present invention to provide greater safety for installing and removing guard rails.

It is still another object of the present invention to provide a tool for installing guard rails that can be operated by one person.

It is still a further object of the present invention to hold guard rails at both ends.

It is still another object of the present invention to secure a damaged guard rail before removal to prevent spring back from the damaged guard rail.

It is a further object of the present invention to provide a tool for installing guard rails that is easily operated.

It is still another object of the present invention to provide a device for installing guard rails that is both durable and inexpensive.

SUMMARY OF THE INVENTION

A Guard Rail Tool is provided with a fixed handle which has an outside end and an inside end. A fixed claw extends toward the inside end of the fixed handle. A rotatable handle is also utilized and a means is provided for mounting the rotatable handle and the fixed claw on the fixed handle. A rotatable claw extends toward the inside end of the fixed handle and a means is included for mounting the rotatable claw on the rotatable handle.

DETAILED DESCRIPTION OF THE DRAWINGS

DETAILED DESCRIPTION OF THE NUMERALS

| NUMERAL | DESCRIPTION |
|---|---|
| 11 | Two Handles |
| 13 | Fixed Handle |
| 15 | Rotatable Handle |
| 17 | Outside End |
| 19 | Guard Rail |
| 21 | Locking Ring |
| 23 | Inside End (Fixed Handle) |
| 25 | Cross Bar |
| 27 | Flat Strips |
| 29 | Fixed Claw |
| 30 | Hook (Fixed Claw) |
| 31 | Opening (Cross Bar) |
| 33 | Pivot Pin |
| 35 | Inside End (Rotatable Handle) |
| 37 | Side Member |
| 39 | Opening (Side Member) |
| 41 | Head (Pivot Pin) |
| 43 | Opening (Pivot Pin) |
| 45 | Wire Retainer |
| 47 | Opening (Rotatable Handle) |
| 48 | Outside End (Rotatable Handle) |
| 49 | Cam Link |
| 51 | Plates (Cam Link) |
| 53 | Two Openings |
| 55 | Centerline |
| 57 | Opening |
| 59 | Pivot Pin |
| 61 | Opening |
| 63 | Rotatable Claw |
| 65 | Outside End (Rotatable Claw) |
| 67 | Inside End (Rotatable Claw) |
| 69 | Pivot Member |

-continued

| NUMERAL | DESCRIPTION |
|---|---|
| 71 | Opening (Pivot Member) |
| 73 | Pivot Pin |
| 75 | Hook (Rotatable Claw) |
| 76 | Slot |
| 77 | Post |
| 79 | Fixed Nut |
| 81 | Bolt |
| 82 | Extension Assembly |
| 83 | Head (Bolt) |
| 84 | Plate |
| 85 | Movable Nut |
| 86 | Overlapping Ends |
| 87 | Bolt Holes |
| 89 | Lower Edge |
| 91 | Top Edge |
| 95 | Lug |
| 97 | Bolt Holes |
| 99 | Removable Plate |

DETAILED DESCRIPTION OF THE PREFERRED EMBODIMENT

Figure 1:
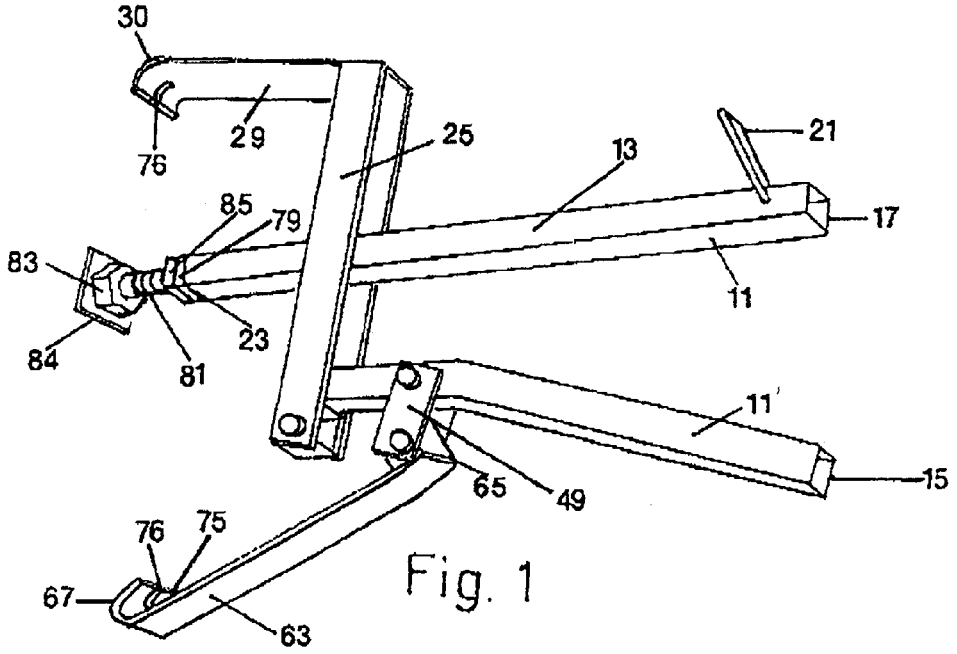
FIG. 1 is a pictorial view of the Guard Rail Tool.

Referring now to FIG. 1, the Guard Rail Tool is shown. Two handles 11 are provided, one handle being a fixed handle 13 and the other handle being a rotatable handle 15. At the outside end 17 of the handles 11, the end most remote from guard rail 19 when in use, a locking ring 21 is mounted to pivot on the fixed handle 13 to lock over the rotatable handle 15 to prevent the handles 11 from opening. The locking ring 21 may also be mounted to pivot on the rotatable handle 15. The handles 11 are constructed of tubular material preferably having a generally square cross section. The opposite end of the fixed handle 13 from the locking ring 21 is the inside end 23. Toward the inside end 23 of the fixed handle, which is the end closest to the guard rail 19 when in use and most remote from the locking ring 21, a cross bar 25 is located. The cross bar 25 is formed from two flat strips 27 which are aligned with one another, one flat strip 27 being on each side of the fixed handle 13 to which the flats strips 27 are firmly secured, preferably by welding. The cross bar 25 is oriented generally at right angles to the fixed handle 13 and essentially extends a similar distance on each side of the fixed handle 13. At one end of the cross bar 25, the fixed claw 29 is located. The fixed claw 29 is formed from a strip of metal. The fixed claw 29 has an inside end and an outside end and is rigidly secured at its outside end to the end of the cross bar 25. The fixed claw 29 slopes out and away from the fixed handle 13 and the fixed claw 29 bends back around to form a hook 30 at its inside end.

At the end of the cross bar 25 remote from the fixed claw 29, an opening 31 through the cross bar 25 is provided to hold a pivot pin 33. The rotatable handle 15, like the fixed handle 13, has an inside end 35. On the inside end 35 of the rotatable handle 15, a side member 37 is secured to the side of the rotatable handle 15 that is most remote from the fixed handle 13. An opening 39 extends through the side member 37 which aligns with the opening 31 in the end of the cross bar 35. The pivot pin 33 extends through both the cross bar 25 and the side member 37 to mount the rotatable handle 15 to rotate so that the rotatable handle 15, can move back and forth to and from the fixed handle 13. This pivot pin 33, and all other pivot pins referred to herein, may be held in place by any suitable means but, as is known, each pivot pin preferably has a head 41 at one end and a opening 43 at the opposite end through which a wire retainer 45 is inserted.

Figure 2:
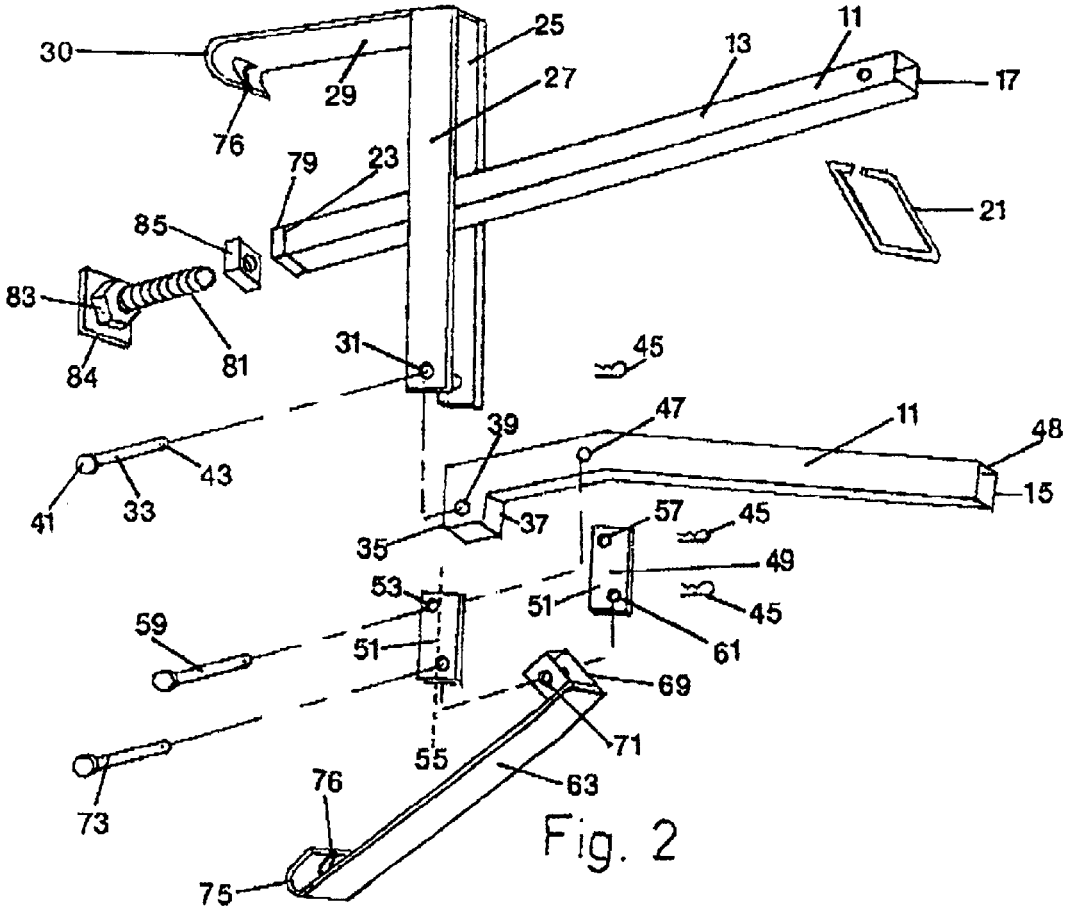
FIG. 2 is an exploded pictorial view showing the inside end of the rotatable handle and the end of the cross bar as well as the cam link with the openings offset from one another.

A short distance from the side member 37, there is an opening 47 in the rotatable handle 15 that is generally parallel to the opening 39 in the side member 37. The major portion of the length of the rotatable handle 15 extends from the opening 47 to the outside end 48 of the rotatable handle 15. A cam link 49, as best seen in FIG. 2, is mounted on the opening 47. The cam link 49 is a pair of plates 51 which are comparatively short. At each end of the cam link 49 there are openings 53 which are generally parallel with the openings 31, 39 through the cross bar 25 and the side member 37. The cam link 49 has a centerline 55. As best seen in FIG. 2, one opening 57 of the two openings 53 through the cam link 49 is aligned with the opening 47 in the rotatable handle 15. A pivot pin 59 is located through the rotatable handle 15 and the cam link 49. The opening 57 through the cam link 49, which is aligned with the opening 47 in the rotatable handle 15, is generally located to one side of the centerline 55 of the cam link 49. The opening 61 at the opposite end of the cam link 49, remote from the rotatable handle 15 is offset from the centerline 55 to the opposite side of the centerline 55. This non alignment of the openings 53 in the cam link 49 creates the locking action of the handles 11 when the handles 11 are brought together when mounted on the guard rail 19.

Figure 7:
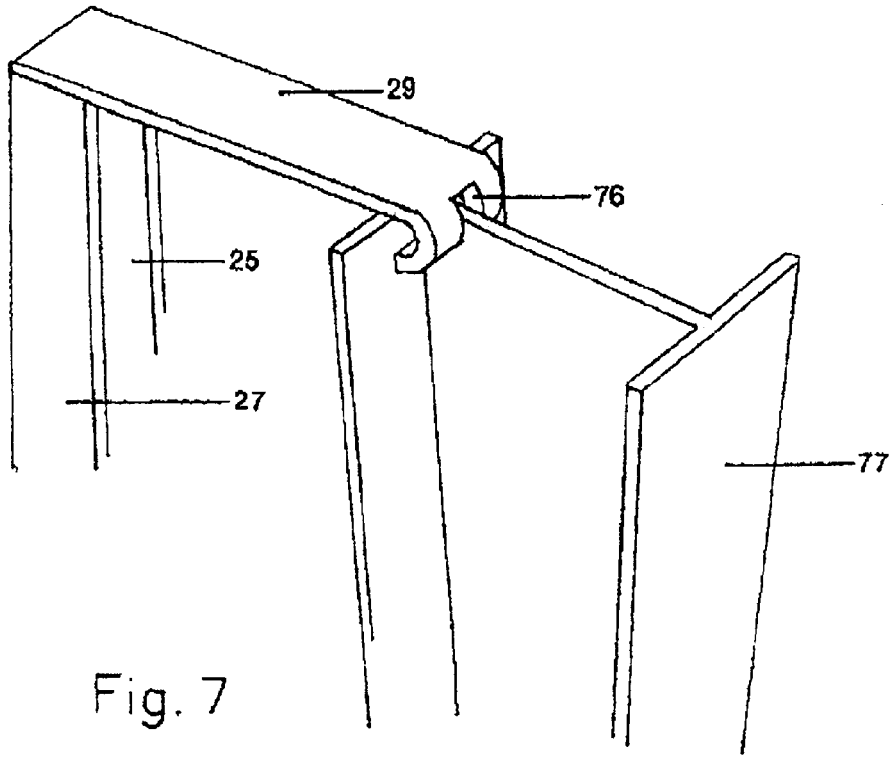
FIG. 7 is a pictorial view showing the slot in the fixed claw affixed to the top of the post.

A rotatable claw 63, as is best seen in FIG. 1, is mounted on the opening 61 in the cam link 49 remote from the rotatable handle 15. The rotatable claw 63 is longer than the fixed claw 29 and has an outside end 65 and an inside end 67. This greater length is necessitated by the location of the cam link 49. A pivot member 69 is secured to and located on the rotatable claw 63 at the outside end 65 which is closest to the clip ring 21. An opening 71 is located in the pivot member 69. The opening 71 in the pivot member 69 is aligned with the opening 61 in the cam link 49 remote from the rotatable handle 15 and a pivot pin 73 is placed in the opening 71 in the cam link 49 and the opening 71 in the pivot member 69 on the rotatable claw 63. The rotatable claw 63 has a shape similar to the fixed claw 29 but with the rotatable claw 63 against the end of the cross bar 25, the rotatable claw 63 extends toward the inside end 23 of the fixed handle 13 and bends toward the fixed claw 29 before bending around to form a hook 75 similar to the hook 30 of the fixed claw 29. As best seen in FIG. 2 and FIG. 7, a slot 76 is located in both the hook 30 and the hook 75. The slot 76 is used to attach to the top of the post 77.

As seen in FIG. 1, a fixed nut 79 is secured to the inside end 23 of the fixed handle 13. Instead of using a fixed nut 79, any internally threaded member could be secured to or made a part of the fixed handle 13 at the inside end 23. A bolt 81 is threaded into the fixed nut 79 or internally threaded member. The bolt 81 forms an extension assembly 82 to the fixed handle 13. The bolt 81 has a head 83. A plate 84 is secured to the head 83 of the bolt 81. The plate 84 applies pressure to both sides of the indentation of the guard rail 19, thus forcing the sections of the guard rail 19 together. A movable nut 85 is placed on the bolt 81 before the bolt 81 is threaded into the fixed nut 79. The movable nut 85 may be turned until it presses against the fixed nut 79 thereby locking the bolt 81 in a selected position. With the extension assembly 82 in place, the end 23 of the fixed handle 13 is superceded by the extension assembly 82 and the end of the fixed handle 13 becomes the plate 84.

The fixed handle 13, the rotatable handle 15, the fixed claw 29 and the rotatable claw 63, as well as the cam link 49 and the cross bar 25 are all substantially within a common plane.

Figure 3:
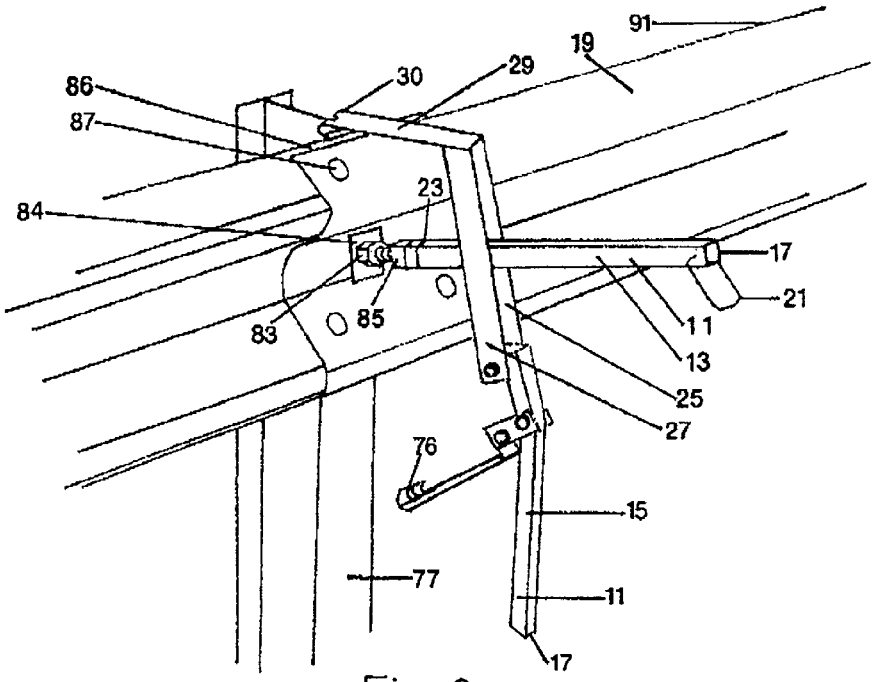
FIG. 3 is a pictorial view of the Guard Rail Tool mounted on overlapping ends of guard rail, with the Guard Rail Tool still unlocked.
Figure 4:
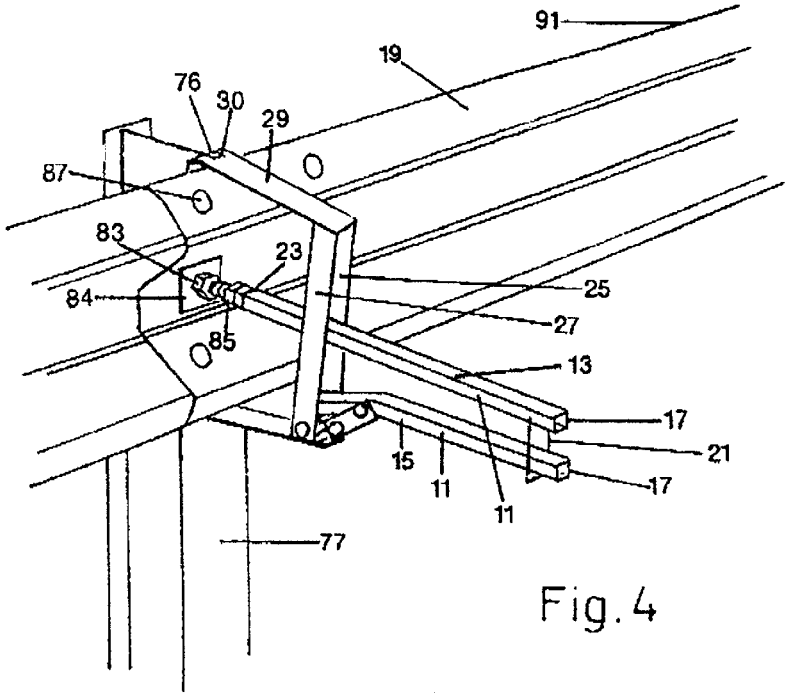
FIG. 4 is a pictorial view of the Guard Rail Tool affixed to overlapping ends of two guard rail sections with both handles locked together.

Referring to FIG. 3, the Guard Rail Tool is mounted on the overlapping ends 86 of the sections of guard rail 19 just to one side of the bolt holes 87 of the guard rails 19. The rotatable claw 63 is preferably placed so as to grasp both sections of the guard rail 19 at the lower edge 89 of the guard rail 19. The plate 84 on the bolt 81, which is adjusted to set the amount of tension, is placed against the face of the guard rails 19. Then, the fixed claw 29 is placed over the top edge 91 of the overlapping ends 86 of the guard rails 19 and the handles 11 are forced together. The cam link 49 is pulled down and locks the handles 11 together. The plate 84 on the head 83 of the bolt 81 or the inside end 23 of the fixed handle 13, in the absence of the extension assembly 82, presses against the guard rail 19. The interaction of the claws 29,63 and the fixed handle 13 press the guard rails 19 together. As a matter of safety, in view of the forces present in the Guard Rail Tool when the guard rails 19 are clamped together, the locking ring 21 previously discussed positively secures the handles 11 together. The locking ring 21 may be mounted on either handle 11. The locking ring 21 provides positive assurance that the handles 11 will not open unexpectedly.

The use of two or more Guard Rail Tools together offers the greatest efficiency. With two Guard Rail Tools clamping contiguous, overlapping guard rails 19 together, the greatest efficiency of operation can be achieved. In the path of progression of guard rail installation, the first overlapping ends 86 of guard rail 19 and the second overlapping ends 86 of guard rail 19 are clamped together by the Guard Rail Tool. When the first overlapping ends 86 are bolted together and to an adjoining post, the Guard Rail Tool is removed and placed on the third successive overlapping ends 86 of guard rail 19. The second overlapping ends 86 of guard rail 19 are then bolted together and to the adjoining post. Then the Guard Rail Tool from the second overlapping ends 86 is placed on the fourth overlapping ends 86 of guard rails 19. This sequence of moving one Guard Rail Tool over the other Guard Rail Tool provides the most efficient technique for installing guard rails 19.

With the Guard Rail Tool, if the overlapping ends 86 of guard rail 19 are not perfectly aligned so that the bolt holes 97 are not exactly aligned, a drift pin may be used to align the bolt holes 97. The Guard Rail Tool permits the needed movement of the guard rails 19 by the use of a drift pin and then, after such movement, holds the sections of guard rail 19 together in the desired alignment.

The description heretofore set forth pertains to the securing of overlapping ends 86 of guard rail. Once the overlapping ends 86 are secured together, it is necessary to mount the guard rail to the post 77. The Guard Rail Tool also may be used to force the guard rails 19 against the post 77 for fastening. As previously described, a slot 76 is located in both the hook 30 and the hook 75. The post 77 is of I-beam construction and the slot 76 preferably of the fixed claw 29 fits over the center web of the I-beam.

Figure 5:
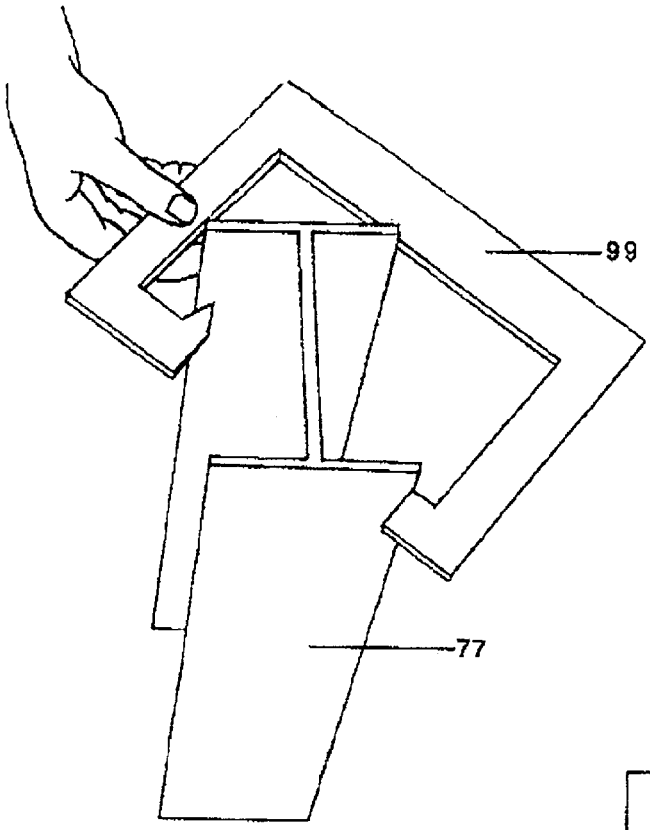
FIG. 5 is a pictorial view showing the removable plate being placed on post constructed from an I-beam.
Figure 6:
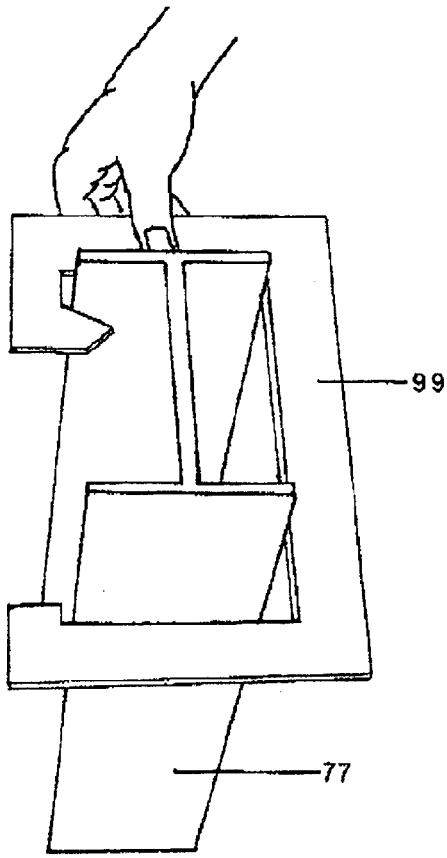
FIG. 6 is a pictorial view showing the removable plate on the post.

As best seen if FIG. 5 and FIG. 6, to secure the rotatable claw 63, a removable plate 99 is placed on the post 77. The removable plate 99 as a G-shape and may be turned for placing the removable plate 99 on the post 77 and then may be turned again for removal.

Figure 8:
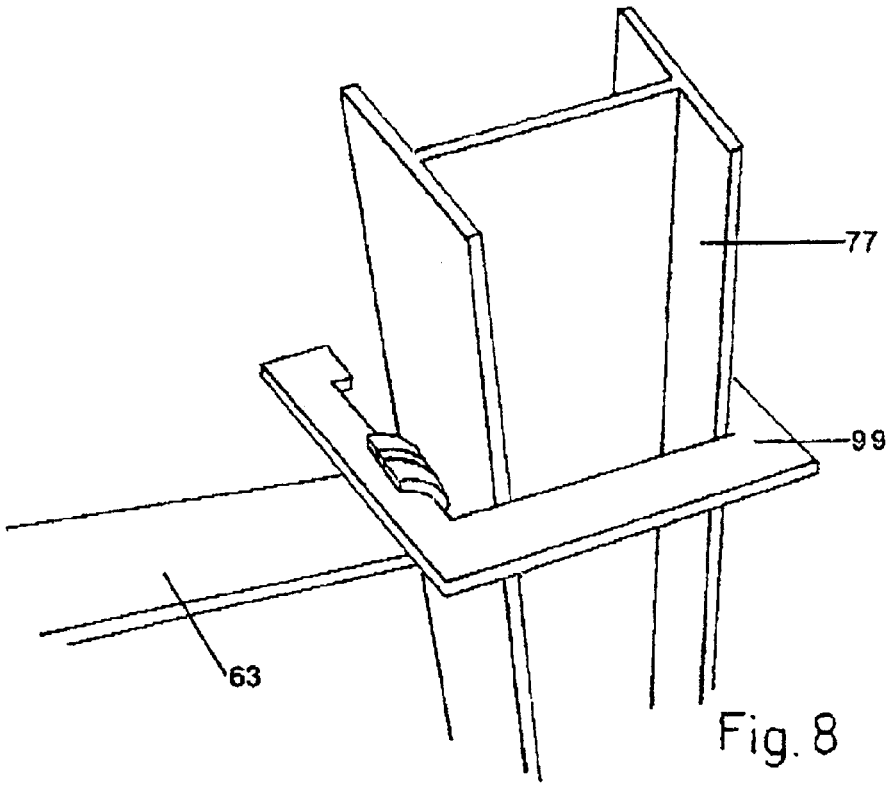
FIG. 8 is a pictorial view showing the rotatable claw affixed to the removable plate.

As best seen in FIG. 8, with the removable plate 99 slightly below the guard rail 19, the rotatable claw 63 is secured to the removable plate 99. As previously stated, the fixed claw 29 is secured, using the slot 76 to fit over the web of the I-beam at the top of the post 77. The closing of the handles 11, forces the guard rail 19 against the post 77.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A Guard Rail Tool for installing guard rails along roads and highways, said Guard Rail Tool comprising:

a fixed handle having an outside end and an inside end;

a fixed claw extending toward the inside end of the fixed handle;

a rotatable handle;

a cross bar secured to the fixed handle for mounting the rotatable handle and the fixed claw;

a rotatable claw extending toward the inside end of the fixed handle; and means for mounting the rotatable claw to rotate on the rotatable handle.

2. A Guard Rail Tool according to claim 1 wherein the means for mounting the rotatable claw on the rotatable handle includes a cam link, the cam link having two ends, one end being mounted to rotate on the rotatable handle and the rotatable claw being mounted on the other end of the cam link to rotate on the cam link.

3. A Guard Rail Tool according claim 1 wherein the fixed handle includes an adjustable extension at the inside end.

4. A Guard Rail Tool for installing guard rails along roads and highways, said Guard Rail tool comprising:

a fixed handle having an inside end and an outside end;

a cross bar secured to the fixed handle toward the inside end;

a fixed claw mounted on one end of the cross bar, the fixed claw having an inner end and an outer end, the fixed claw extending toward the inside end of the fixed handle;

a rotatable handle mounted to rotate on the end of the cross bar opposite from the fixed claw, the rotatable handle having an outside end and an inside end;

a cam link having two ends, one end being mounted to rotate on the rotatable handle; and a rotatable claw mounted to rotate on the end of the cam link opposite from the end of the cam link mounted on the rotatable handle, the rotatable claw extending beyond the inside end of the rotatable handle.

5. A Guard Rail Tool according to claim 4 wherein the rotatable handle includes a side member, the side member being mounted on the end of the cross bar.

6. A Guard Rail Tool according to claim 4 wherein the rotatable claw has an inside end and the inside end of the rotatable claw bends around to form a hook.

7. A Guard Rail Tool according to claim 4 wherein the rotatable claw has an inside end and the inside end of the rotatable claw bends around to form a hook, the hook having slot in it.

8. A Guard Rail Tool for installing guard rails along roads and highways, said Guard Rail tool comprising:

a fixed handle having an inside end and an outside end, the fixed handle having an adjustable extension at the inside end;

a cross bar having two ends secured to the fixed handle toward the inside end, the cross bar being located substantially at right angles to the fixed handle;

a fixed claw having an inside end and an outside end, the outside end being secured to one end of the cross bar, the inside end extending toward the inside end of the fixed handle, the fixed claw bending around at its inside end to form a hook;

a rotatable handle having an inside end and an outside end;

a side member secured to the inside end of the rotatable handle;

a cam link having a centerline and having two ends, one of the ends of the cam link being mounted to rotate on the rotatable handle; and a rotatable claw mounted on the end of the cam link opposite from the end of the cam link mounted on the rotatable handle, the cam link being mounted on the rotatable handle along one side of the centerline of the cam link and the rotatable claw being mounted on the opposite side of the centerline of the cam link to form a cam locking action.

9. A Guard Rail Tool according to claim 8 further including a locking ring mounted to rotate on the rotatable handle about the fixed handle.

10. A Guard Rail Tool according to claim 8 further including a locking ring mounted to rotate on the fixed handle about the rotatable handle.

11. A Guard Rail Tool for installing guard rails on posts along roads and highways, said Guard Rail Tool comprising:

a removable plate having a G-shape for mounting about a post directly below the guard rail;

a fixed handle having an outside end and an inside end;

a fixed claw extending toward the inside end of the fixed handle;

a rotatable handle;

means rigidly mounted on the fixed handle for mounting the rotatable handle and the fixed claw;

a rotatable claw extending toward the inside end of the fixed handle, the rotatable claw having a slot in it; and means for mounting the rotatable claw to rotate on the rotatable handle, the rotatable claw for engaging the removable plate.

12. A Guard Rail Tool according to claim 11 wherein the means rigidly mounted on the fixed handle for mounting the rotatable handle and the fixed claw includes a cross bar secured to the fixed handle.

13. A Guard Rail Toot according to claim 11 wherein the means for mounting the rotatable claw on the rotatable handle includes a cam link, the cam link having two ends, one end being mounted to rotate on the rotatable handle and the rotatable claw being mounted on the other end of the cam link to rotate on the cam link.

14. A Guard Rail Tool according to claim 11 wherein the fixed handle includes an adjustable extension at the inside end.

* * * * *